US007410031B2

(12) United States Patent
Jensen

(10) Patent No.: US 7,410,031 B2
(45) Date of Patent: Aug. 12, 2008

(54) BOAT TRAILER BOW ENTRY LADDER ASSEMBLY

(76) Inventor: John S. Jensen, 4651 Mill Pond Rd., Myrtle Beach, SC (US) 29579

( * ) Notice: Subject to any disclaimer, the term of this patent is extended or adjusted under 35 U.S.C. 154(b) by 296 days.

(21) Appl. No.: 11/170,461

(22) Filed: Jun. 29, 2005

(65) Prior Publication Data

US 2007/0000723 A1 Jan. 4, 2007

(51) Int. Cl.
*E06C 5/00* (2006.01)

(52) U.S. Cl. ..... 182/127; 280/414.1

(58) Field of Classification Search ..... 182/127, 182/97, 115; 280/163, 166, 414.1
See application file for complete search history.

(56) References Cited

U.S. PATENT DOCUMENTS

| | | | | |
|---|---|---|---|---|
| 3,083,784 | A * | 4/1963 | Urian | 182/88 |
| 4,094,527 | A * | 6/1978 | Miller | 414/559 |
| 4,146,941 | A | 4/1979 | Haslam | |
| 4,724,925 | A | 2/1988 | Ritten | |
| 4,943,076 | A | 7/1990 | Tripke | |
| 5,113,782 | A | 5/1992 | McCarty | |
| 5,799,962 | A | 9/1998 | Barnhart | |
| 5,896,946 | A | 4/1999 | Brackett | |
| 6,386,318 | B1 | 5/2002 | Smith | |
| 6,419,047 | B1 * | 7/2002 | Adshead | 182/180.2 |
| 6,523,846 | B1 * | 2/2003 | Bennett et al. | 280/163 |
| 6,719,317 | B1 * | 4/2004 | Grovender et al. | 280/414.1 |
| 6,755,146 | B1 | 6/2004 | Garelick et al. | |
| 6,782,840 | B1 | 8/2004 | Garelick et al. | |
| 6,926,241 | B2 * | 8/2005 | Garrett | 248/229.1 |
| 6,932,193 | B2 * | 8/2005 | Tombarello | 182/93 |
| 2004/0083942 | A1 | 5/2004 | Dunn | |
| 2004/0159279 | A1 | 8/2004 | Garelick et al. | |
| 2006/0169536 | A1 * | 8/2006 | Davis | 182/127 |

* cited by examiner

*Primary Examiner*—Alvin Chin Shue
(74) *Attorney, Agent, or Firm*—Harleston Law Firm LLC

(57) ABSTRACT

A boat trailer ladder assembly for entering or exiting the bow of a boat on a boat trailer includes:

(a) a generally trapezoidal-shaped platform portion attachable to the boat trailer between a winch assembly of the trailer and a trailer hitch assembly of the trailer; and (b) a ladder portion including a boarding ladder and a brace device, the boarding ladder including two substantially parallel, spaced apart side rails and a plurality of ladder steps extending between the ladder side rails, the ladder steps having a spaced horizontal relationship with one another, the lower ends of the boarding ladder being attached to the platform portion, the brace device having an upper end movably affixed to at least one of the ladder steps or one of the side rails of the boarding ladder; wherein a lower end of the brace device is attachable to a post of the winch assembly of the boat trailer.

12 Claims, 7 Drawing Sheets

BOAT TRAILER BOW ENTRY LADDER ASSEMBLY

BACKGROUND OF THE INVENTION

1. Technical Field

The present invention relates to a ladder assembly on a boat trailer for facilitating entry to and exit from the bow of a boat on the trailer, more particularly an adjustable boat trailer bow entry ladder assembly having a base platform, a brace device, and a boarding rail on one side.

2. Background Information

Boating is a very popular pastime in geographic areas that are close to large bodies of water. With this popularity, boats have increased in number and grandeur. Since most boat owners use boat trailers to haul their boats to the bodies of water, larger and larger sized boats are being towed by large trailers with two and three axels to accommodate these big boats. Occasionally, one even sees a four axel trailer at the boat ramp. These large boats have a high freeboard and require ladders to climb into the boat when the boat is parked on the trailer. Also, boaters often go boating by themselves and do not have qualified assistants to help launch or retrieve the boat. The boat trailer ladder assembly of the present invention facilitates the off-loading (launching) and on-loading of a boat onto a boat trailer as the trailer sits with its hubs in the water on a sloping boat ramp connected to a tow vehicle.

Currently available boat ladders include ladders that are mounted on a boat stem for entering the boat from the water, or exiting the boat into the water (e.g., for swimming or water skiing). They also include folding ladders mounted on a boat. Ladders mounted on a ship for traveling to and from an upper deck of the ship are also known.

During the launching (off-loading) phase, the boater can disconnect the trailer's attaching cable or strap, and use the bow ladder assembly of the present invention to step up from the boat trailer into the boat. The boater can then power up the boat, back the boat off the trailer, and then dock and secure the boat. The boater can then leave the boat and retrieve the unloaded trailer from the loading ramp.

After the outing, loading the boat back onto the boat trailer requires boating skills. For example, the boater must move the trailer to the boat ramp, and line up and propel the boat to where the retrieving cable or strap of the trailer can be attached to the boat. The boat can then be winched onto the trailer. This loading phase is especially difficult after a tiring day in the sun water skiing or the like. Often the boat is propelled up to the attaching post, but the boat must still be secured to the boat before the boat trailer can be pulled out of the water. The present invention allows the boat operator to safely descend to the trailer platform from the bow of the boat, secure the boat, and step out onto the dry portion of the ramp. Where the tow vehicle is a pickup truck, the boater can step directly onto the tow vehicle from the ladder assembly. The tow vehicle and loaded trailer can be driven up the ramp and onto a level area to allow other boaters to either retrieve or launch their boats.

Another advantage of the present invention is that it provides a permanent, secure bow entry ladder, so the user can work on the boat at home or in dry storage, for example. A stable step ladder entry for accomplishing boat repairs is highly desirable for safety and efficiency.

BRIEF SUMMARY OF THE INVENTION

The present invention is a boat trailer ladder assembly for entering or exiting the bow of a boat on a boat trailer, which comprises:

(a) a generally trapezoidal-shaped platform portion attachable to the boat trailer between a winch assembly of the trailer and a trailer hitch assembly of the trailer; and (b) a ladder portion comprising a boarding ladder and a brace device, the boarding ladder comprising two substantially parallel, spaced apart side rails and a plurality of ladder steps extending between the ladder side rails, the ladder steps having a spaced horizontal relationship with one another, the lower ends of the boarding ladder being attached to the platform portion, the brace device having an upper end movably affixed to at least one of the ladder steps or one of the side rails of the boarding ladder; wherein a lower end of the brace device is attachable to a post of the winch assembly of the boat trailer. The ladder portion preferably further comprises a boarding railing, which extends in an upward direction from an upper end of at least one of the ladder side rails of the boarding ladder.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 7 is a front perspective view of a boat trailer bow entry ladder assembly according to the present invention, shown with a boat on the boat trailer.

DETAILED DESCRIPTION OF THE INVENTION

Figure 1:
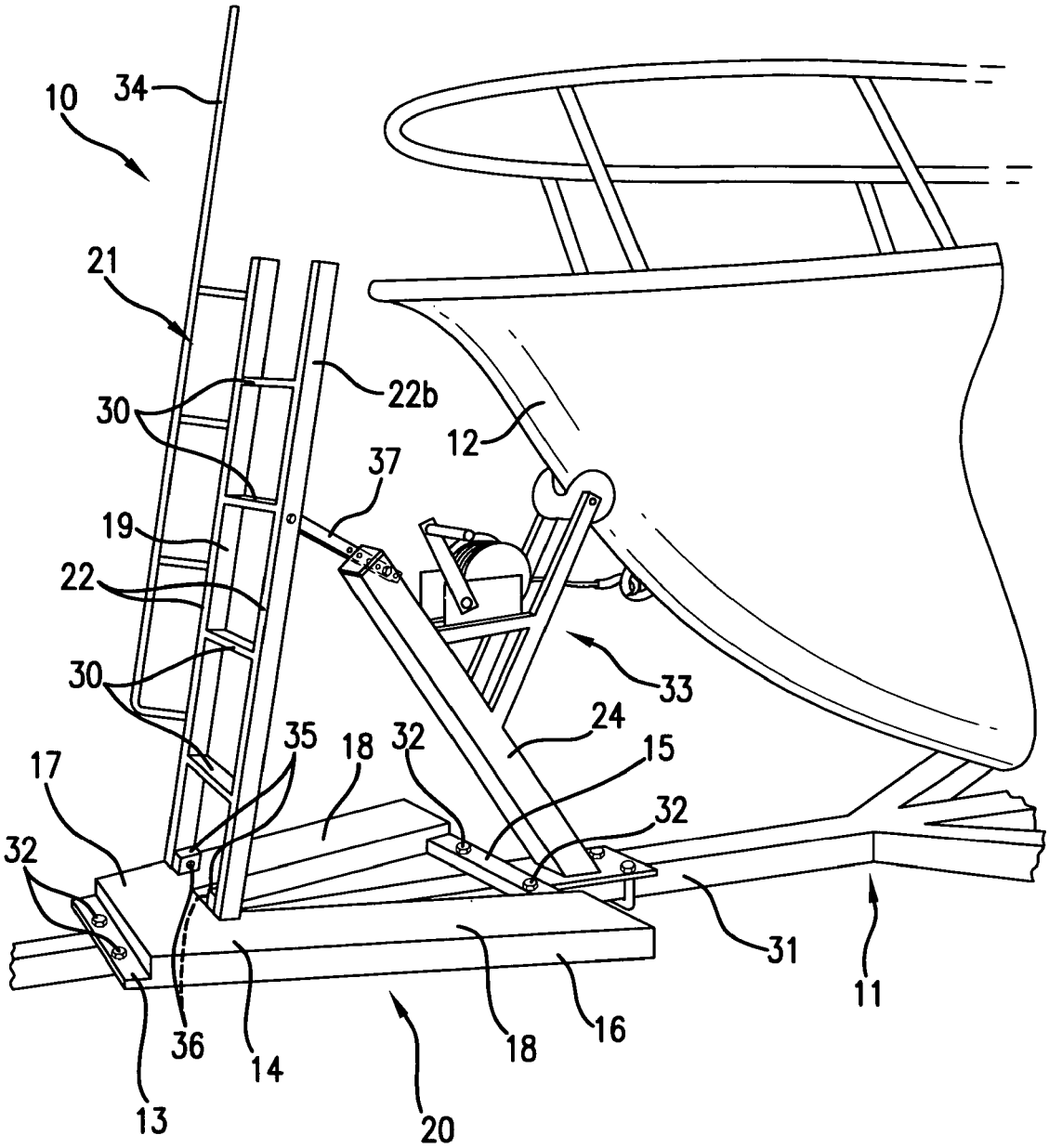
FIG. 1 is a front perspective view of a boat trailer bow entry ladder assembly according to the present invention, shown with a boat on the boat trailer.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2:
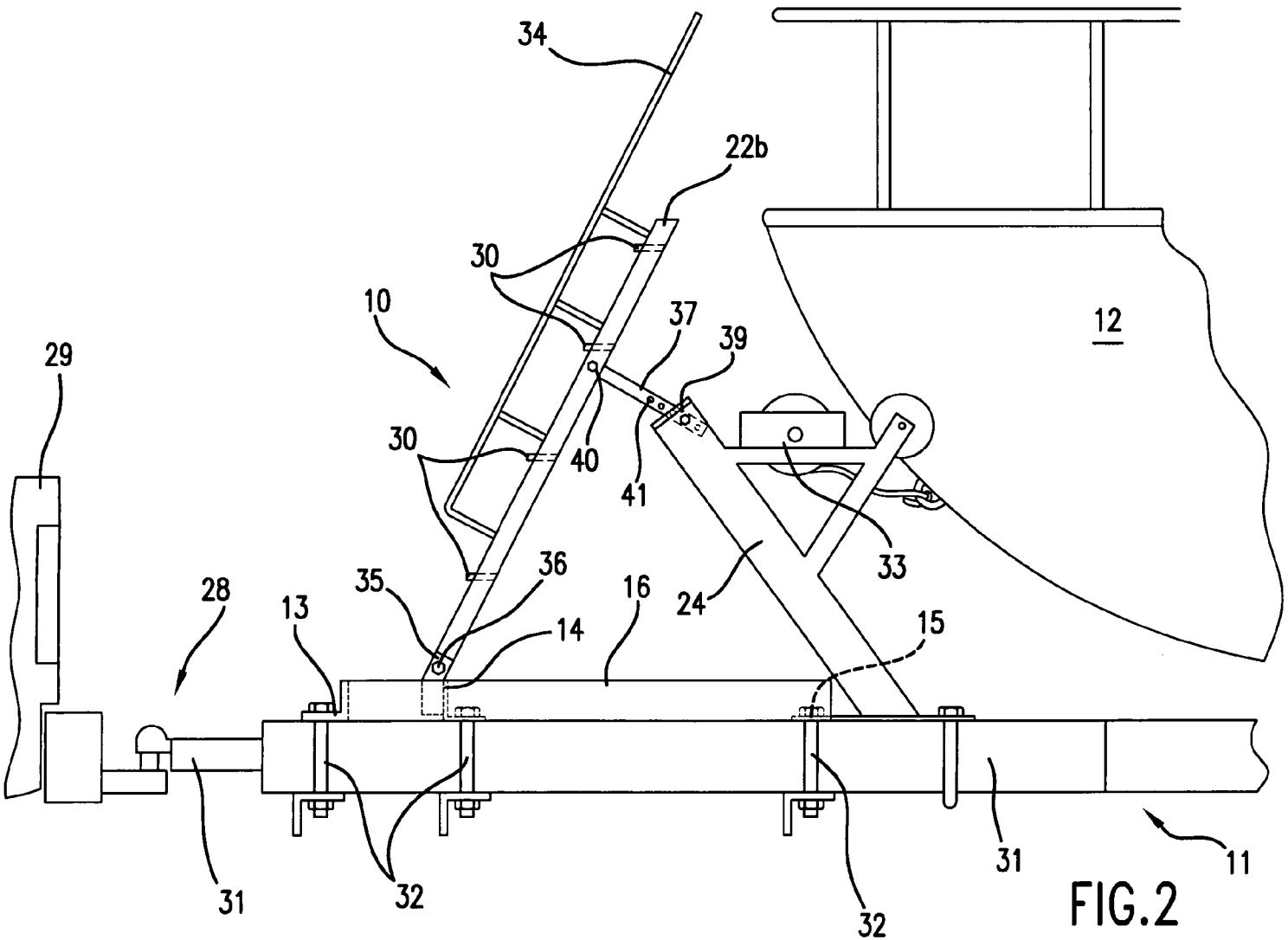
FIG. 2 is a side elevational view of a boat trailer bow entry ladder assembly according to the present invention, shown in use.
Figure 3:
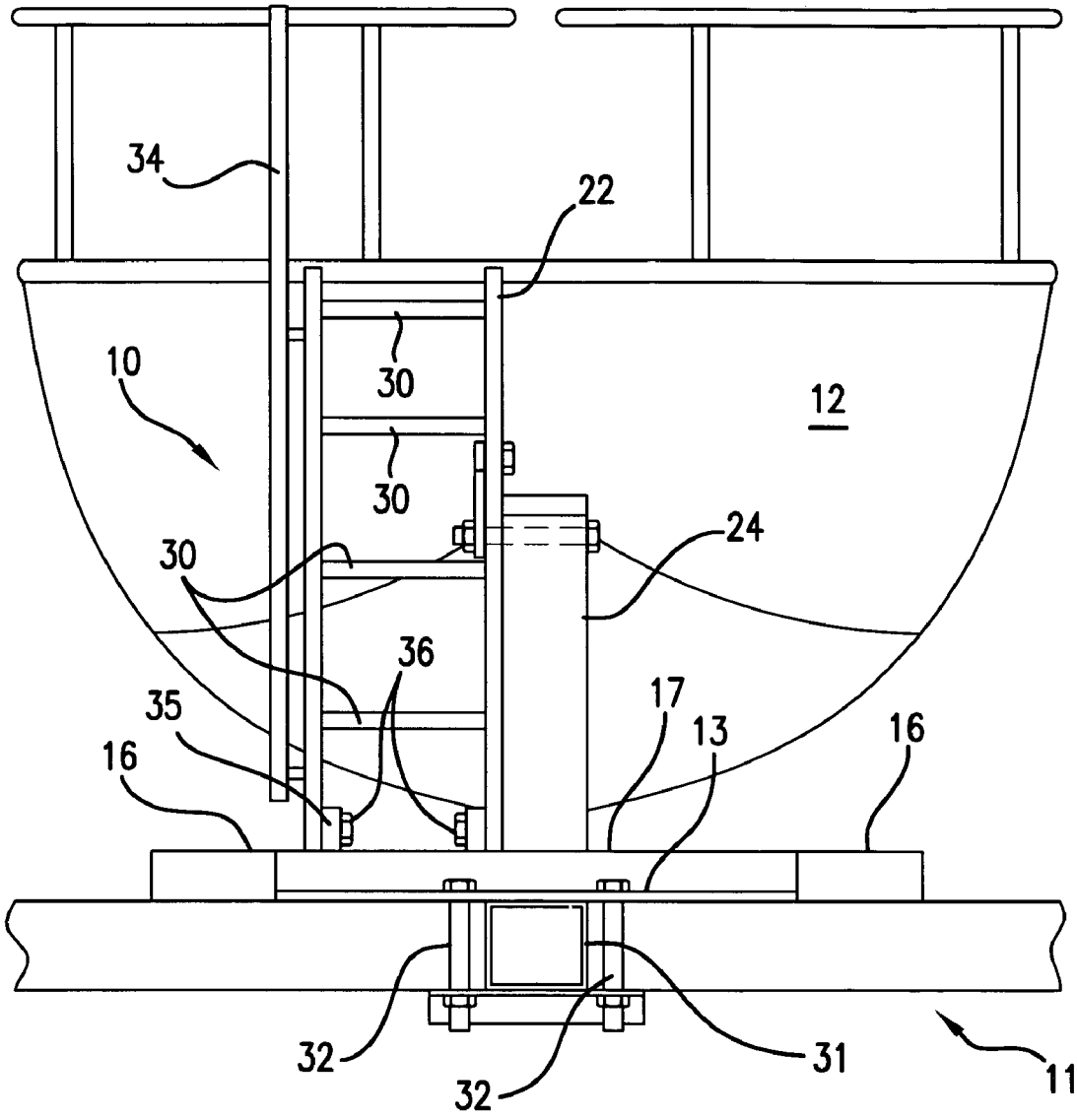
FIG. 3. is a front elevational view of a boat trailer bow entry ladder assembly according to the present invention, shown with a boat.

Referring to FIGS. 1 through 3, a bow entry/exit ladder assembly according to the present invention, generally referred to herein as 10, is mountable on a boat trailer 11. The boat trailer bow entry/exit ladder assembly 10 includes a generally vertical, though slightly inclined, ladder portion 21 attached to a generally horizontal, generally trapezoidal-shaped access platform portion 20. The platform portion 20 is mountable on the boat trailer 11 between a winch assembly 33 of the boat trailer 11 and a hitch assembly 28 of the boat trailer (see FIG. 2). The bow entry ladder assembly 10 allows a boater entry onto or exit from the bow 12 of a boat on the adjacent boat trailer 11.

The platform portion 20 of the ladder assembly includes a forward platform support 13, a middle platform support 14, and a rear platform support 15, as shown in FIGS. 1-3. The forward platform support 13, middle platform support 14, and rear platform support 15 are connected by two outer supports 16. The front and middle platform supports support a front platform surface 17. Two side platform surfaces 18 of a suitable width are fastened to the middle and rear platform supports 14, 15 and reinforced by the outer supports 16. The side surfaces 18 are of sufficient width to allow a user to stand upright, preferably between several inches and about a foot wide. The front ends of the side platform surfaces 18 abut a rear side of the front platform surface 17. Taken as a unit, the platform portion 20 forms a generally triangular or trapezoidal shape that can bear the weight of one user, or even two users at the same time. The platform portion may be an integral, molded, generally trapezoidal-shaped piece.

Figure 5:
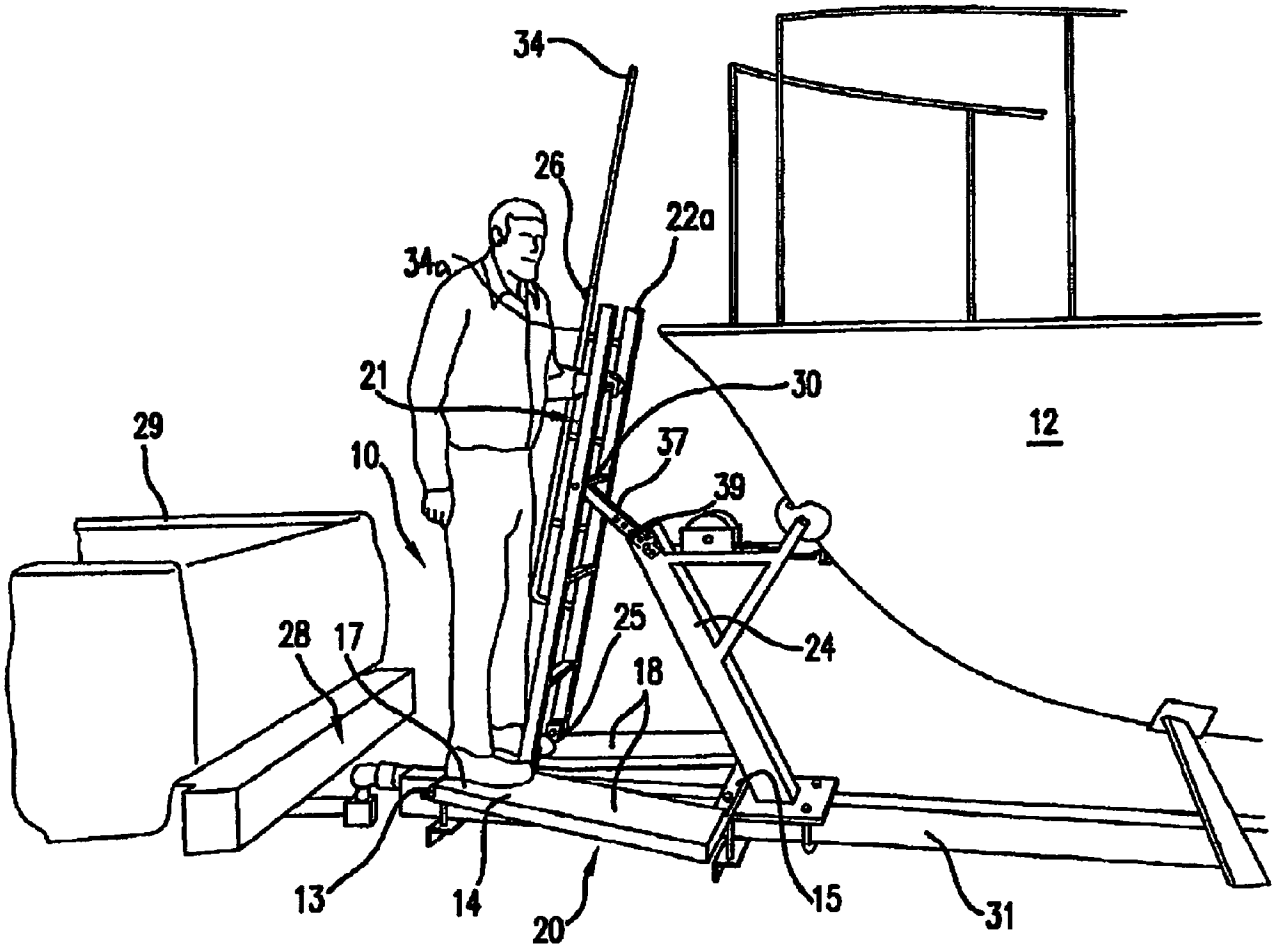
FIG. 5 is a side perspective view of a boat trailer bow entry ladder assembly according to the present invention, shown with a user on the platform.
Figure 6:
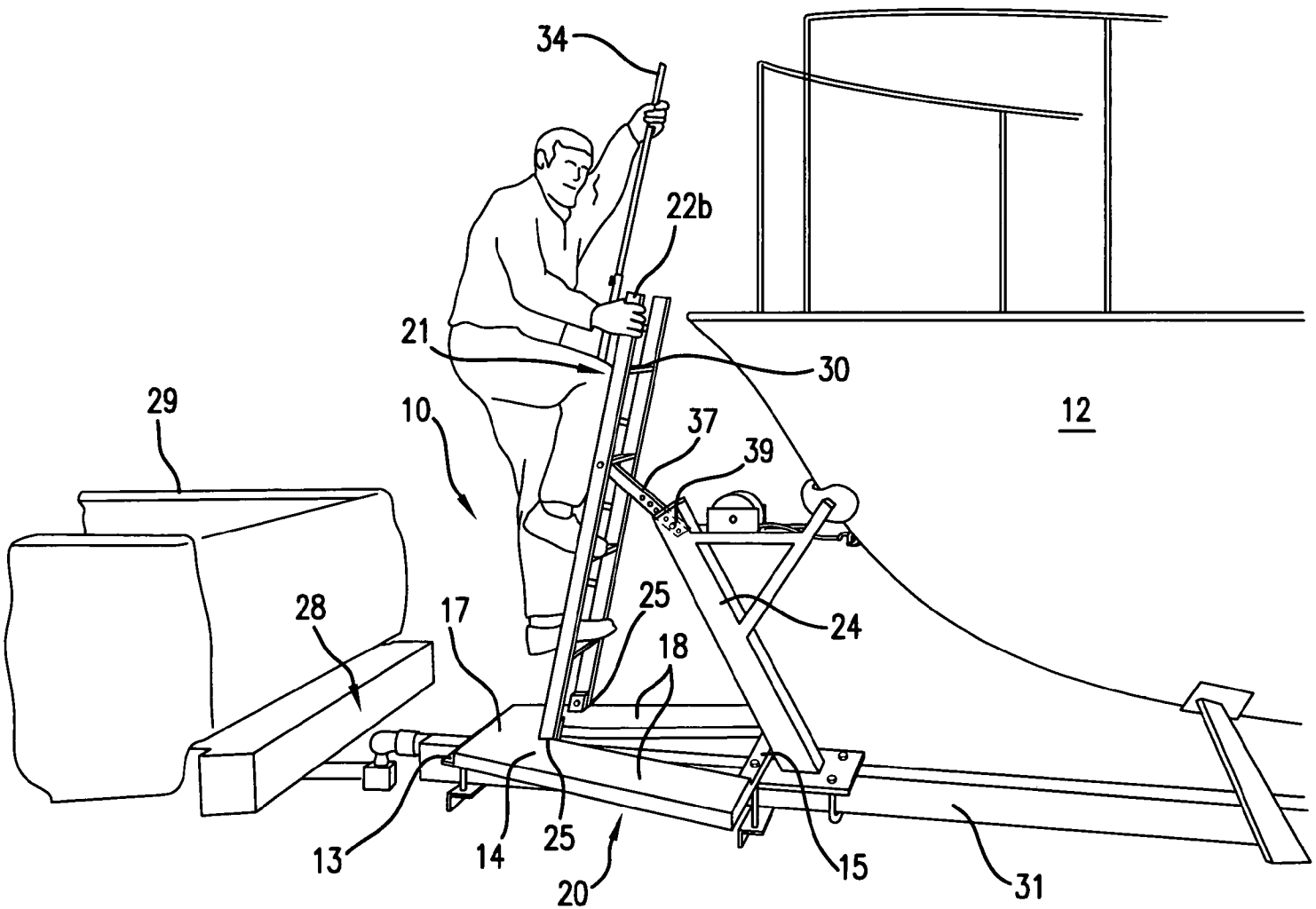
FIG. 6 is a side perspective view of a boat trailer bow entry ladder assembly according to the present invention, shown with a user on the ladder steps.
Figure 1:
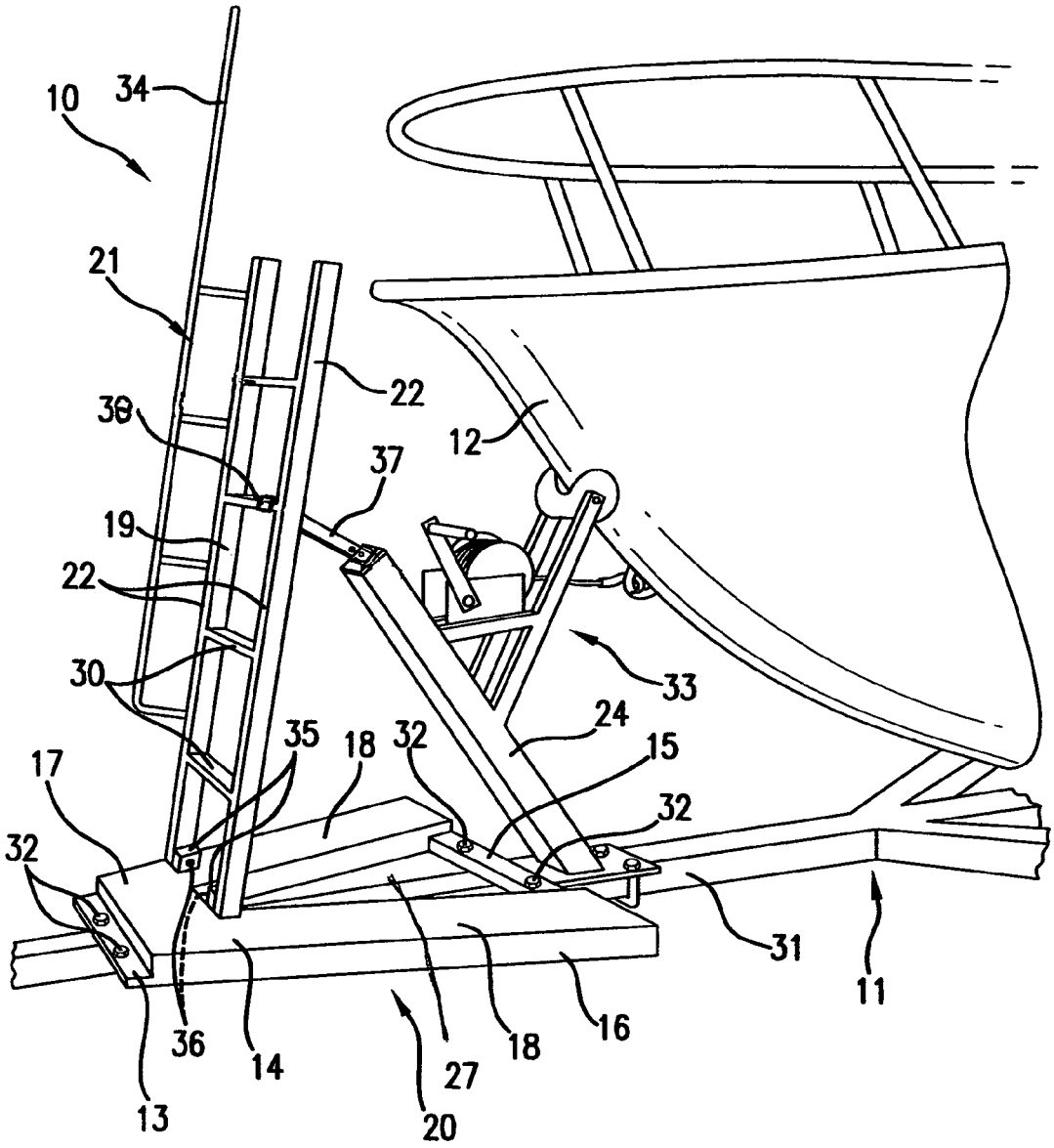

The platform portion 20 is at the base of the ladder portion 21. One end of a boarding ladder 19 of the ladder portion 21 extends upwardly from the platform portion 20. The lower ends 25 of two generally parallel side rails 22 of the boarding ladder 19 (see FIGS. 5 and 6) are attached to the middle platform support 14 of the platform portion 20, preferably by connecting brackets 35 (see FIGS. 1-3). The lower ends 25 of the ladder side rails 22 preferably substantially straddle one of the side surfaces 18 of the platform portion 20, as seen in FIGS. 1, 5 and 6, with one side rail end 25 adjacent the outside of the straddled side surface 18, and the other side rail end 25 adjacent the inside of the opposite side surface 18 (see FIG. 6). This has been found herein to provide additional room on the opposite (non-straddled) side surface 18 for the comfort of the user.

To use the present ladder assembly 10 on arrival at the boat ramp area, the user steps onto the platform portion 20 from the bumper or bed of a towing vehicle 29, or the ground. The user then climbs the boarding ladder 19 and steps across to the bow 12 of the boat. On leaving the boat, the user steps onto the top step 30 of the ladder 19, descends the boarding ladder 19, steps onto the platform portion 20, and then steps onto the towing vehicle 29 or the ground, as desired.

The boat trailer bow entry ladder assembly 10 is preferably an add-on attachment to a conventional boat trailer 11. However, it can be built onto a boat trailer during manufacture of the trailer. The add-on bow entry ladder assembly 10 is preferably bolted onto a trailer tongue 31 (center towing member) of the trailer 11. Where the boat trailer has a more elaborate forward frame, it is preferable to bolt the ladder assembly 10 onto the boat trailer's forward frame. Any suitable, sturdy connecting bolt assembly 32, such as U bolts or the like, can be used to attach the ladder assembly 10 securely to the trailer tongue 31, or the forward frame of the trailer. Connecting bolts 32 are inserted through bolt holes in the forward platform support 17 and the rear platform support 15 to connect the platform portion 20 to the trailer tongue 31. The ladder assembly 10 is movable up and down the trailer tongue 31 for optimal positioning in order for the user to easily access the boat bow 12.

The ladder assembly 10 may be attached to the boat trailer permanently by welding it to the trailer 11. In that case, the trailer frame material should be similar to the material from which the ladder assembly 10 is made, e.g., steel to steel, aluminum to aluminum. The ladder assembly 10 is installed between the towing vehicle 29 and the trailer winch assembly or the boat rest (see FIG. 2). The ladder assembly 10 does not interfere with connecting the boat trailer 11 to the towing vehicle 29.

Boat trailer bow entry ladder assemblies 10 can be manufactured of various metals and/or composites of suitable strength. The ladder assembly 10 is easy to mount to the boat trailer 11. No significant modifications to the trailer 11 are necessary. The ladder assembly 10 can be mounted on conventional boat trailers of different sizes and types, regardless of which company manufactured the trailer. For boaters with more than one boat and boat trailer, the ladder assembly 10 can surprisingly be easily switched from one trailer to another. On occasion, slight modifications should be made to do so.

The generally horizontally oriented ladder boarding steps 30 are in spaced relationship to one another and interconnect the two generally vertically oriented ladder side rails 22 of the boarding ladder 19. The ladder side rails 22 are generally parallel to one another, as are the generally flat ladder boarding steps 30. As seen in FIGS. 1 and 3, the ladder boarding steps 30 are preferably the same size as one another. They may be lined or treated with a nonskid material, if desired. The ladder boarding steps 30 are preferably not curved, and the boarding ladder 19 is preferably not triangular in shape. The ladder railing 34 is mounted alongside one ladder side rail 22*a*.

Referring to FIGS. 5 and 6, the single boarding railing 34 is mounted within a boarding railing support 34*a*, so that the boarding railing 34 telescopes from the boarding railing support 34*a* as desired. To use the boarding railing 34, the user pulls it out into the elongated, ready-for-use position as shown in FIGS. 5 and 6 and locks it in place using a locking mechanism 26 on the boarding railing support 34*a*. The locking mechanism 26 extends through the side of the boarding railing support 34*a* and onto the boarding railing 34. The locking mechanism 26 can be a pin or a locking bolt, for example.

The boarding railing 34 steadies the user as he or she steps from the top step 30 onto the bow of the boat, or vice versa. When the ladder assembly 10 will not be in use for awhile, or where the boat bow 12 is low and easily accessed from the top step, the user unlocks the locking mechanism 26 and pushes the boarding railing 34 down into the hollow side rail 22*a*. The opposite side rail 22*b* may also have a boarding railing 34. However, one boarding railing 34 is preferred because it permits the user to swing one leg out over the opposite side rail 22*b*, which preferably has no boarding railing, to step onto the bow and turn around. The left side is preferred because most users have a dominant right leg. When departing the boat, the user stands on the bow 12 in front of the boarding ladder 19, grasps the boarding railing 34 with his or her right hand, and swings his or her left leg out over the other side rail 22*b* to stand on the top step 30, switching to the left hand for grasping the boarding railing 34. The user then descends the boarding ladder 19, as shown in FIG. 6.

As depicted in FIGS. 1-3, the boarding railing 34 is installed along one of the side rails 22, preferably not the side rail closest to the center of the boat and trailer (here, 22*b*). As seen in FIG. 3, a lower portion of the boarding railing 34 is affixed to the outside of the side rail 22 for sturdiness, with the lower portion being in spaced parallel relation to the side rail. An upper portion of the boarding railing 34 extends beyond the upper end of the side rail 22 for the user to grasp as he or she steps onto the boat bow 12.

The present invention allows the boat operator to safely descend to the trailer platform from the bow of the boat (see FIG. 5), secure the boat, and step out onto the dry portion of the boat ramp without getting wet. This is advantageous for boaters of any age, but particularly for older or infirm boaters and children. A single boater of any age out by himself or herself can handle the boat and boat trailer without assistance. If there are others in the boating party, they can relax since the user does not require assistance. It is also advantageous for other boats in line behind the user to use the boat ramp, since entry and departure proceed so quickly for boat trailers with a ladder assembly.

With continued attention to FIG. 1-4, the ladder portion 21 of the bow entry ladder assembly 10 further comprises a brace device 37, which extends down at an angle from a ladder step 30 or side rail 22 of the boarding ladder 30, preferably from the middle rear of the second ladder step. It has been found herein that since a large majority of boat trailer winch assemblies 33 comprise a sturdy post 24, the winch post 24 can be used to brace the boarding ladder 19 of the present ladder assembly 10 without compromising performance of the trailer winch assembly. Just as the present ladder assembly 10 can be moved up or down along the trailer tongue 31, the winch post 24 can ordinarily be moved up or down along the trailer tongue 31.

As the ladder assembly is being installed, the brace device 37, which is preferably substantially rigid, is fixed in place to form an angle between the longitudinal axis of the ladder side rail 22 and the brace device 37. This angle is preferably between about 35 and about 50 degrees, so that the free end of the brace device 37 contacts the winch post 24 of the trailer winch assembly 33 once the ladder assembly 10 is installed on the trailer 11. This angle has been found to allow a user to comfortably access the boat bow 12.

Figure 4:
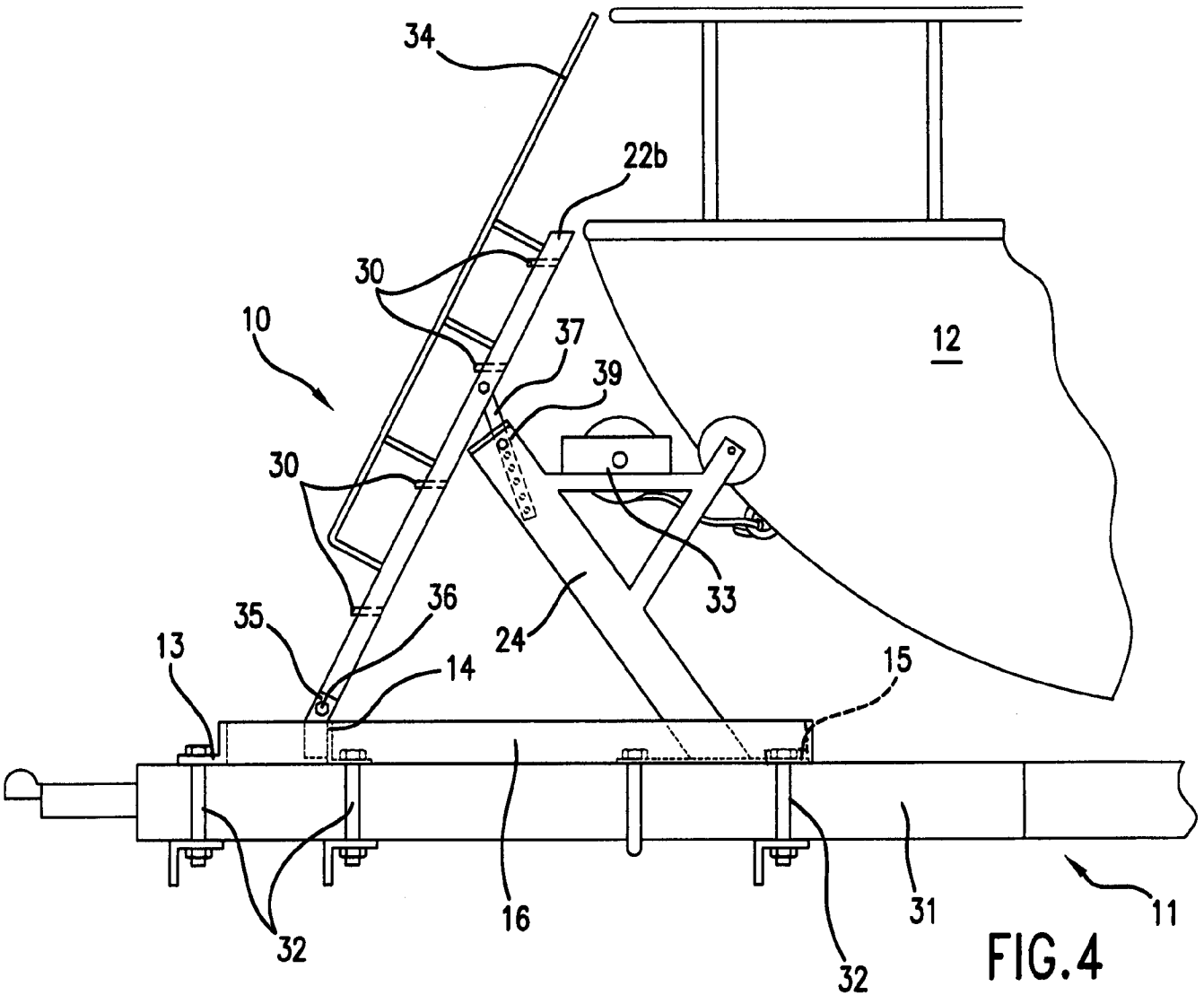
FIG. 4 is a side elevational view of a boat trailer bow entry ladder assembly according to the present invention, shown with the front and side surfaces detached.

Continuing with FIGS. 1 and 2, an upper end of the brace device 37 movably attaches to the centermost ladder side rail 22*b* that is closer to the center of the ladder assembly 10 (see FIG. 1), preferably by a brace ladder bolt 40. Alternatively, it is attached to one of the ladder steps 30. The opposite, lower end of the brace device 37 attaches to the top or side of the winch post 24, preferably by a brace winch bolt 39, as shown in FIG. 1. The brace device 37 comprises a series of apertures 41. The brace winch bolt 39 is inserted through one of these apertures 41, depending on the distance between the ladder and the winch post. This allows adjustment in case the winch post 24 is close to the boarding ladder 19, as shown in FIG. 4, or some distance away from the boarding ladder 19, as illustrated in FIG. 2. The placement of the winch assembly varies from trailer to trailer, and the ladder assembly 10 must be placed so that the boarding ladder 19 is as close as possible to the boat bow, so this feature of the ladder assembly 10 provides latitude.

Another feature of the ladder assembly 10 that allows flexibility is the hole 27 in the platform portion 20, which is formed by the two side platform surfaces 18 and the rear platform support 15 (see FIG. 1). For a boat trailer with only a small distance between the ladder portion and the boat on the trailer, as shown in FIG. 4, the platform portion 20 is placed around the winch post with the two side platform surfaces 18 straddling the winch post 24. The winch post 24 is thus close to the ladder assembly 10, as shown in FIG. 4. Also, the angle between the brace device 37 and the ladder side rail 22*b* in the situation shown in FIG. 4 is smaller than the same angle in the situation depicted in FIG. 2. Once the two side platform surfaces 18 are on either side of the winch post 24, the removable rear platform support 15 is attached to the ends of the two side platform surfaces 18.

Where the brace device is attached to a ladder step 30 as shown in FIG. 7, the upper end of the brace device 37 preferably comprises a brace step collar 38, which encircles the ladder step. The brace collar 38 attaches the brace device to the ladder step 30, or side rail 22, yet allows the brace device to slide along the ladder step, or side rail. This allows the angle of the brace device 37 to be adjusted to meet the particular angle of the winch post 24 on the particular boat trailer 11 being used. Thus, the bow entry ladder assembly 10 is customizable in that the brace device 37 is adjustable, and the platform portion 20 is movable along the trailer tongue 31.

As also shown in FIG. 7, the end of the brace device may be braced against, and fastened to, the end of the winch post 24. Screws or bolts can be used to attach the bracket to the post.

This invention is not a boat ladder mounted on a boat, particularly the stem, for entering the boat from the water, or exiting the boat into the water (e.g., for swimming or water skiing). It is not a folding ladder mounted on a boat. The present invention is also not a ship's ladder mounted on a ship for traveling to and from an upper deck of the ship. The ladder assembly of the present invention is mounted on the boat trailer, not the boat itself and not the towing vehicle. The present ladder assembly 10 does not include a winch. The present invention is particularly intended for accessing the bow of a motor boat on the trailer, and not a pontoon boat or the like. By "lower" herein is meant closer to the ground, and by "upper" is meant closer to the top, "upper" being above "lower" in space.

From the foregoing it can be realized that the described assembly of the present invention may be easily and conveniently utilized as a boat trailer ladder assembly for entering and exiting a boat on the trailer from the bow of the boat. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 Bow entry ladder assembly
11 Boat trailer
12 Boat bow
13 Forward platform support
14 Middle platform support
15 Rear platform support
16 Outer supports
17 Front platform surface
18 Side platform surfaces

19 Boarding ladder
20 Platform portion
21 Ladder portion
22 Ladder side rails
24 Winch post
25 Side rail end
26 Boarding railing locking mechanism
27 Hole in platform portion
28 Trailer hitch assembly
29 Towing vehicle
30 Ladder steps
31 Trailer tongue
32 Connecting bolt assembly
33 Trailer winch assembly
34 Boarding railing
35 Connecting brackets
36 Ladder bolts
37 Brace device
38 Brace step collar
39 Brace winch bolt
40 Brace ladder bolt
41 Brace device apertures

What is claimed is:

1. A boat trailer ladder assembly for entering or exiting the bow of a boat on a boat trailer, the ladder assembly comprising:

(a) a generally trapezoidal-shaped platform portion attachable to the boat trailer between a winch assembly of the trailer and a trailer hitch assembly of the trailer; and (b) a ladder portion comprising a boarding ladder and a brace device, the boarding ladder comprising two substantially parallel, spaced apart side rails and a plurality of ladder steps extending between the ladder side rails, the ladder steps having a spaced horizontal relationship with one another, the lower ends of the boarding ladder being attached to the platform portion, the brace device having an upper end movably affixed to at least one of middle ones of the ladder steps; wherein a lower end of the brace device is detachably attachable to a post of the winch assembly of the boat trailer wherein opposed longitudinal sides of said platform portion comprises two side platform surface legs forming a V-shape with a front platform surface, the attached ends of the ladder side rails straddle one of the side platform surface leg but not the other platform surface leg, wherein the brace device is substantially rigid, the lower end of the brace device comprising a plurality of bolt apertures and being attached to the winch post by a bolt inserted through one of the bolt apertures, an upper end of the brace device comprising a brace step collar that encircles said at least one of middle ones of the ladder step.

2. The ladder assembly according to claim 1, wherein the ladder portion further comprises a boarding railing, the boarding railing extending in an upward direction from an upper end of at least one of the ladder side rails of the boarding ladder.

3. The ladder assembly according to claim 2, wherein the boarding railing is mounted within and telescopes from a boarding railing support.

4. The ladder assembly according to claim 1, wherein the brace device is attachable to the winch post such that an angle of between about 35 and about 50 degrees is formed between the brace device and a longitudinal axis of the ladder side rail.

5. The ladder assembly according to claim 1, wherein the platform portion comprises a forward platform support connected to a middle platform support, which is connected to a rear platform support, the forward and middle platform supports supporting said front platform surface.

6. The ladder assembly according to claim 5, wherein the middle and rear platform supports support said two side platform surfaces.

7. The ladder assembly according to claim 6, wherein the two side platform surfaces straddle the winch post, the rear platform support being detachably attachable to ends of the two side platform surfaces.

8. The ladder assembly according to claim 1, wherein the ladder assembly is an add-on that is fastened to the trailer tongue of a conventional trailer.

9. The ladder assembly according to claim 1, wherein the ladder assembly is fastened to a forward frame of the boat trailer.

10. The ladder assembly according to claim 3, further comprising a locking mechanism on the boarding railing support for locking the boarding railing in an extended or telescoped position.

11. The ladder assembly according to claim 10, wherein the locking mechanism is a pin.

12. The ladder assembly according to claim 2, wherein a lower portion of the boarding railing is affixed to an outside of the ladder side rail, with the lower portion of the boarding railing being in spaced parallel relation to the ladder side rail.

* * * * *